US005160155A

United States Patent [19]

Barachet

[11] Patent Number: 5,160,155

[45] Date of Patent: Nov. 3, 1992

[54] SKATEBOARD HAVING TWO WHEELS IN TANDEM

[76] Inventor: Jacques Barachet, 46, Résidence de la Porte d'Andin, 78760 Pontchartrain, France

[21] Appl. No.: 295,711

[22] Filed: Jan. 11, 1989

[30] Foreign Application Priority Data

Jan. 12, 1988 [FR] France ..... 8800281

[51] Int. Cl.[5] ..... A63C 17/06

[52] U.S. Cl. ..... 280/87.042; 280/11.2; 280/11.23

[58] Field of Search ..... 280/87.042, 87.041, 280/11.23, 11.2

[56] References Cited

U.S. PATENT DOCUMENTS

| | | | |
|---|---|---|---|
| 1,056,357 | 3/1913 | Murdock | 280/87.042 |
| 1,274,889 | 8/1918 | Johnson | 280/87.042 |
| 2,198,667 | 4/1940 | Hagenes | 280/87.042 |
| 3,876,217 | 4/1975 | Copier | 280/11.23 |
| 4,394,029 | 7/1983 | Holmgren | 280/11.23 |
| 4,795,181 | 1/1989 | Armstrong | 280/87.042 |

FOREIGN PATENT DOCUMENTS

| | | | |
|---|---|---|---|
| 554951 | 6/1923 | France | 280/87.042 |

*Primary Examiner*—David M. Mitchell
*Attorney, Agent, or Firm*—Armstrong, Nikaido, Marmelstein, Kubovcik & Murray

[57] ABSTRACT

Skateboard comprising a board (13, 14) mounted only on two wheels (4, 9) positioned in tandem, one at the front and the other at the rear, with a means suitable for providing steering, characterized in that the rear wheel (4) is fixed in direction while the front wheel (9) is freely self-steering, its axle (8) being mounted in a fork (7) capable of pivoting freely about a pivot axis (10) whose point of contact (11) with the ground is situated in front of the point of contact (12) of the front wheel (9) with the ground, and in that the board possesses a front part (13) and a rear part (14) situated on either side of the perpendicular line through the axis of the rear wheel (4).

8 Claims, 2 Drawing Sheets

SKATEBOARD HAVING TWO WHEELS IN TANDEM

The invention relates to skateboards, that is to say essentially sporting apparatuses comprising a board mounted on casters with means for providing steering.

In conventional skateboards, the casters are of small diameter so as to be capable of being arranged entirely under the board, and they are arranged in two pairs, each pair possessing a single axle mounted on an oblique elastic pivot providing steering in opposite directions for the front and the rear. In this manner, by inclining the board about the longitudinal axis, the front axle points one way, towards the interior of the curve corresponding to the low side of the board, while the rear axle points in the opposite direction, that is to say towards the outside of the curve. Steering is thus provided by all four casters at once.

However, this method of steering operates correctly only if the two casters situated at the two ends of the single axle of a pair undergo the same resistance to forward movement. In fact, the slightest imbalance, due for example to irregularities of ground, considerably affects the steering of the corresponding axle, causing it to point in an undesirable direction or to an exaggerated extent. This fault is further emphasized by the fact that the four casters are steering casters and are of small diameter. Hence, apparatuses of this type can operate only on a perfectly smooth surface, generally concreted or asphalted areas specially intended for this purpose, which restricts the use thereof.

Similar apparatuses are likewise known in which the axles are sufficiently long for the casters to extend on either side of the board, which permits the installation of wheels of greater diameter, but with the same disadvantages as above in respect of irregularities of terrain. Such apparatuses are generally used on extensive beaches of wet sand after the tide has gone out, and are sail-driven. In fact, for the reasons set out above, they are not capable of operating on ground which is even slightly irregular.

Moreover, the propulsion of these apparatuses of both types, when not provided by a sail, is obtained either directly by the thrust of a foot on the ground, which is hardly conducive to keeping balance or to obtaining high gliding speeds, or alternatively in a relatively acrobatic manner, imitating the gait of skaters with a tacking movement involving abrupt changes of direction which are obtained by lifting the front pair of wheels clear of the ground by thrusting with the foot on the rear of the board.

The object of the invention is to eliminate the above disadvantages, that is to say to produce a skateboard whose method of steering is insensitive to differences in resistance to the forward movement of the wheels, which makes it possible to mount wheels of large diameter, and which finally permits more convenient propulsion.

The invention comprises mounting the load-bearing board on two wheels only, one of which is a fixed, i.e. non-steering, rear wheel, preferably close to the centre of the board and at the rear of the latter, and the front, steering wheel remote from this centre and mounted in a fork which can be freely oriented about a pivot axis relative to the front of the board, and arranged in a manner such that this pivot axis meets the ground at a point situated forward of the point of contact of the front wheel with the ground.

This fork preferably comprises a means of restoration towards the position of alignment, which means may be simply constituted by an inclination of the pivot axis relative to the vertical from top to bottom and from front to back.

Other features of the invention will be apparent from the description which follows of an embodiment and of an alternative embodiment, taken as examples and shown in the attached drawing, in which.

Figure 1:
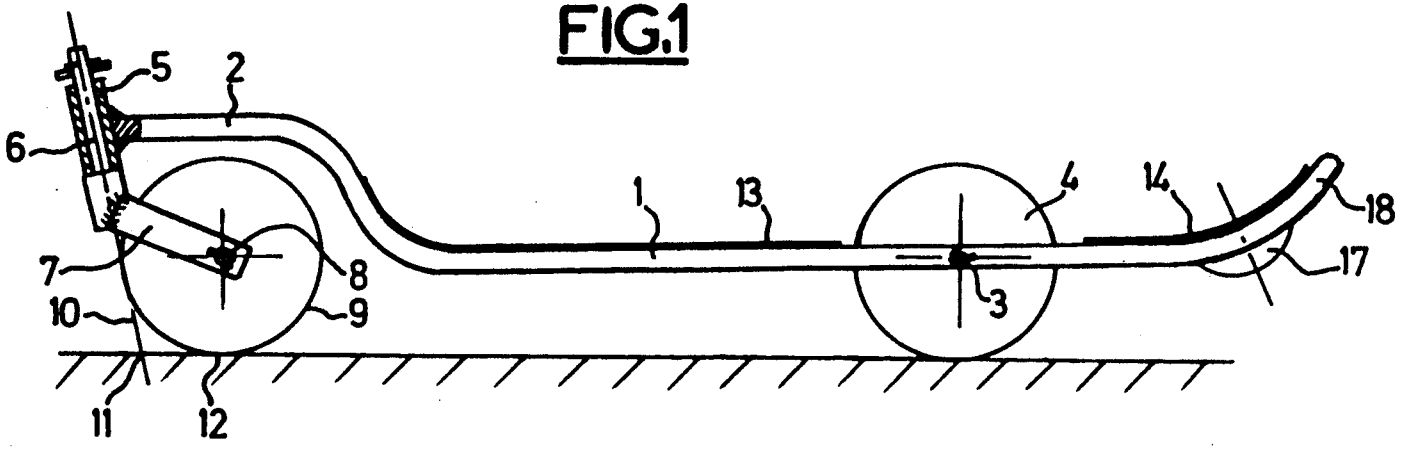
FIG. 1 is a view in elevation and partial section of the first type of embodiment.
Figure 2:
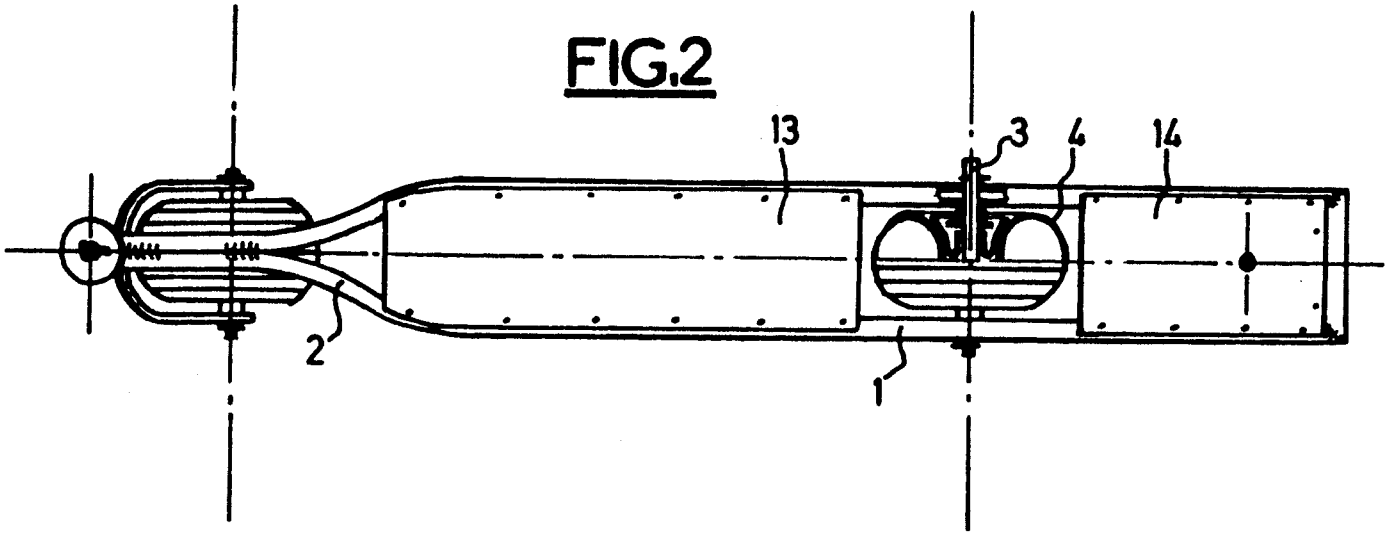
FIG. 2 is a plan view with partial section of this same type of embodiment.

The skateboard according to FIGS. 1 and 2 is formed by a tubular chassis possessing a low rear part 1 and a higher front part 2. On the rear part 1 is mounted the rear axle 3 of a non-orientable rear wheel 4, while the front part 2 possesses a tubular end 5 in which rotates freely pivot 6 of a fork 7 which supports the axle 8 of the front wheel 9.

In accordance with the invention, the pivot axis 10 of the pivot 6 and of the tubular end 5 meets the ground at a point 11 located in front of the point of contact 12 of the front wheel 9 with the ground, so that the front wheel is self-steering.

The low chassis 1 makes it possible to fit large-diameter wheels 4 and 9 while supporting a board sufficiently close to the ground to be stable, this board possessing a front part 13 and a rear part 14 separated by the passage of the rear wheel 4, in a manner such that, when the user stands on this board, with one foot forward on the part 13 and one foot back on the port 14, the rear axle 3 is close to but slightly behind the perpendicular line of his centre of gravity, while the front axle 8 by contrast is far in front of this centre.

If the user, thus positioned on the board 13 and 14, imparts to his body a twisting movement about the axis, while optionally increasing his own moment of inertia by spreading his arms, this produces a pivoting of the apparatus about the vertical of the rear axle 3, close to the vertical axis of the user, consequently producing the lateral displacement of the front part 2 in one direction or the other by virtue of the self-steering effect of the front wheel 9.

At the same time this same movement helps to provide the propulsion of the apparatus if the angle of steering of the pivot 6 is limited by a stop or by opposing forces. Such a propulsion naturally assumes an alternation of twisting movements in opposite directions, which likewise produces a tacking movement but one which includes more gentle changes of direction without lifting the front wheel clear of the ground, in other words without any acrobatic character.

Moreover, when the apparatus is in movement, if the user leans with the board 13–14 to one side, this causes, by a purely static effect, the front wheel to deviate in a manner such as to enter the curve towards the lower edge of the board.

In this movement, the differences in resistance to forward movement which the wheels 9 and 4 may encounter have no effect on the functioning of the steering, which makes it possible, by virtue in particular of the use of large, pneumatically-tyred wheels, to operate the varied terrain which is more or less irregular.

Figure 3:
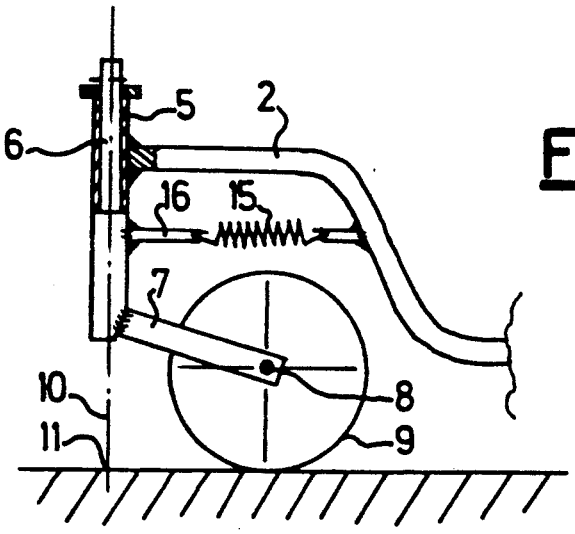
FIG. 3 is a partial view in elevation of the front part of the alternative embodiment.

To improve the stability of steering, both by a dynamic rocking effect and by a static effect of inclining the board, it is preferable to provide a means of restoring the fork 7 to the axial position, which is obtained in the example shown in FIGS. 1 and 2 by inclining the pivot 6 in the direction shown, that is to say from top to bottom and from front to back, which is the opposite direction to that generally used for apparatuses fitted with a handle bar. However, as an alternative , it would be possible, as in the example shown in FIG. 3, to use a vertical pivot 6 or a pivot of a slightly opposed inclination, on condition that a restoring spring 15 is provided which acts on the fork 7 via a lever 16, or any other equivalent elastic restoring means.

In addition to the first function, which is that of providing stability of steering, as has just been seen, these restoring means, whether they take the form of inclination of the pivot or elastic restoring, may likewise be sufficient in general to limit the angular deviation of the fork 7 necessary to ensure dynamic propulsion as explained above. It is however possible to complete the assembly with an effective angular stop, preferably an elastic stop.

Although the skateboard according to the invention possesses only two wheels mounted in tandem, the lateral stability of the user during movement is nevertheless ensured in the same way as for conventional skateboard by the simple fact that turning takes place in the direction of the inclination of the board.

The skateboard according to the invention can advantageously be completed with a braking device, comprising for example a brake shoe 17 fixed under the rear part 14 of the board and a rear end 18 of the chassis, preferably raised, to act directly on the ground. In the event that the user desires to brake, and in that case only, he shifts his centre of gravity to the rear of the axle 3 by thrusting with his rear foot on the board 14, in a manner such as to lift the front wheel 9 clear of the ground and cause the shoe 17 to bear on the ground. This braking is therefore autostable, since any excess braking produces, by dynamic effect, the relative propulsion of the user forwards, which partly relieves the load on the shoe 17 and consequently reduces this excess braking, and vice versa. Moreover, the frictional forces of the shoe 17 on the ground act behind the rear wheel 4, which is then the only wheel to bear on the ground, likewise producing a stabilisation of steering during braking.

The skateboard according to the invention is therefore extremely simple in design and use and makes it possible to move very safely on the most varied terrain.

Of course, the board could likewise be propelled in a conventional manner by thrusting with a foot on the ground or with the aid of a sail of the wind-surfing type, or alternatively it could be fitted with a low-capacity motor acting directly on the rear wheel 4, whose fixed character specifically favours this adaptation.

I claim:

1. A skateboard comprising:

a board having a front end for receiving a first foot of a user, a back end for receiving a second foot of a user, and a longitudinal axis;

front and rear wheels having respective axles and positioned in tandem and mounted to said board, said front wheel mounted at said front end and said rear wheel mounted on an axle in an opening in said board provided intermediate said front end and said back end, said wheels being aligned along said longitudinal axis, said rear wheel being mounted with a fixed axis of rotation relative to said longitudinal axis; and a fork pivotally mounted on said front end of said board and having an axis of pivoting, said front wheel being carried on its axle by said fork and having a point of contact on the ground which is to the rear of an extended point of contact of the axis of pivoting of the fork, whereby said front wheel si self-steering.

2. A skateboard according to claim 1 further comprising means for restoring said fork to a median position aligned with said longitudinal axis.

3. A skateboard according to claim 2 wherein said means for restoring comprises means for mounting said axis of pivoting such that said axis of pivoting is inclined from the top to bottom and from front to back with respect to said board.

4. A skateboard according to claim 2, wherein said means for restoring comprises an elastic member.

5. A skateboard according to claim 4, wherein said elastic member comprises a spring.

6. A skateboard according to any one of claims 1 through 5, wherein said wheels comprise elastic tires, and wherein said board is located above to the ground a distance less than a diameter of said rear wheel.

7. A skateboard according to any one of claims 1 through 5, further comprising a brake shoe positioned beneath the back end of said board, whereby rocking said board about the axle of said rear wheel brings said brake shoe into contact with the ground for braking said skateboard.

8. A skateboard according to any one of claim 1 through 5, wherein a rearmost part of said back end is raised upwardly with respect to said board.

* * * * *